US006050811A

United States Patent [19]

Stein

[11] Patent Number: 6,050,811

[45] Date of Patent: Apr. 18, 2000

[54] IGNITER

[75] Inventor: Matthew Stein, Truckee, Calif.

[73] Assignee: Duraflame, Inc., Stockton, Calif.

[21] Appl. No.: 09/316,662

[22] Filed: May 21, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS 5,967,768 10/1999 Saito et al. ..... 431/153

5,980,242 11/1999 Man ..... 431/153

*Primary Examiner*—Carroll Dority

*Attorney, Agent, or Firm*—Loeb & Loeb LLP

[57] ABSTRACT

A hand held, flammable gas igniter includes a handle with a thumb activated trigger extending, out of the handle top, a child safety lock mounted in the handle bottom, a cylinder filled with a flammable gas enclosed within the handle and a hollow tube extending forward from the handle to deliver the gas, when ignited, to a desired location, such as charcoal in a barbecue or wood in a fireplace. When the child safety lock is activated the trigger is released so that it can move downward and forward into the handle causing an L-shaped rocker to pivot forward, opening a gas flow valve on the cylinder, delivering the flammable gas to the end of the hollow tube. The movement of the trigger also activates a piezoelectric spark generator, delivering an igniting spark to the gas at the end of the tube.

7 Claims, 6 Drawing Sheets

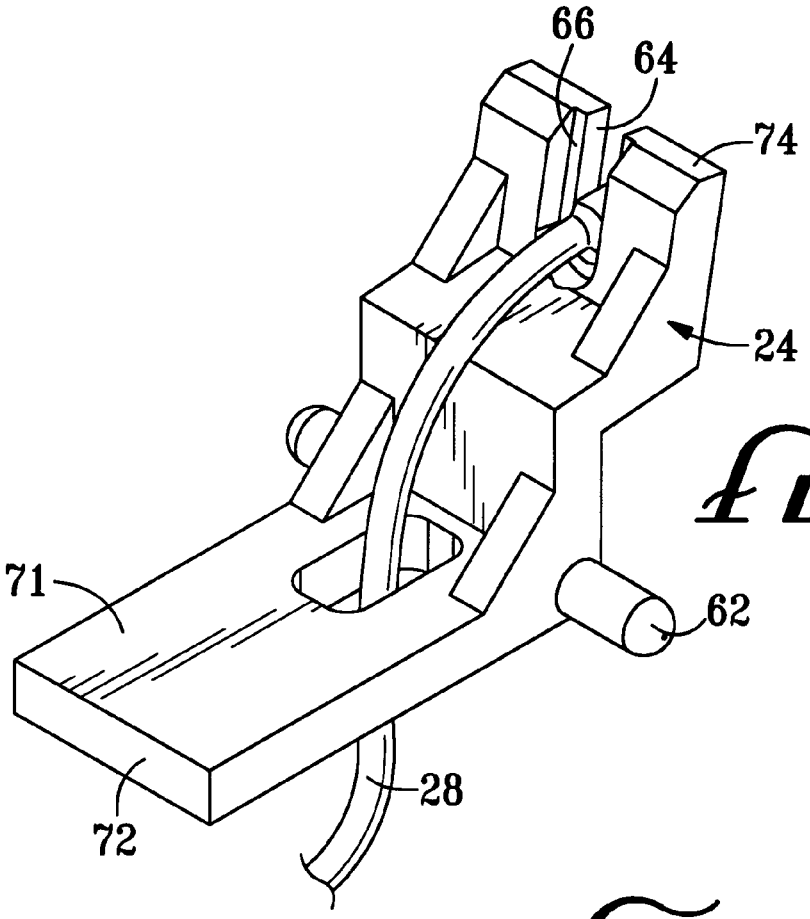
FIG. 10
FIG. 11
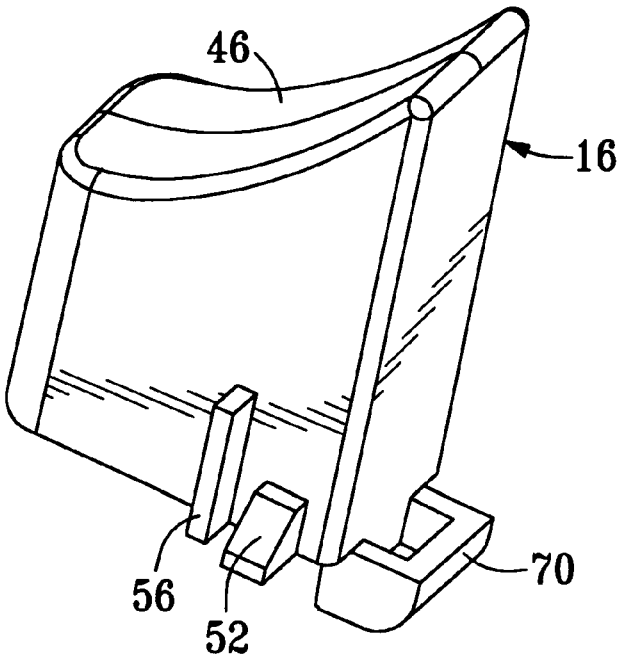

IGNITER

BACKGROUND OF THE INVENTION

1. Area of the Art

The present invention relates to a device for providing a controlled gas fired flame for use in igniting flammable materials, particularly artificial or natural logs in a fireplace or charcoal or wood in a cooking fire or stove. More particularly, the invention relates to hand held devices which contain a fuel source, an igniter for the fuel, a delivery tube for presenting a flame at a distance spaced from the hand of the operator and various controls and safety devices to trigger the flame, control the size of the flame and prevent inadvertent ignition of the flame.

2. Description of the Prior Art

Numerous utility and design patents have issued covering various mechanical features of such devices, means for igniting the flammable gas contained therein, and numerous external, non-functional features. All of the relevant utility patents include a gas canister, a trigger and a wand. Some of the prior devices incorporate a trigger in the handle, the trigger activated in a manner similar to a gun, while others use a top mount trigger which is depressed into the device or slid along the top of the device to cause ignition. Most patents have means to ignite the gas and some have a valve to vary the gas flow rate.

U.S. Pat. Nos. 5,738,507 and 5,326,256 to Tokai show a linear body with a gun trigger. The trigger applies pressure directly to the valve opening mechanism on the fuel tank as well as to a piezoelectric igniter. Depressing the trigger causes the gas to be released and feed to a nozzle at the end of the wand and simultaneously activate the piezoelectric sending current to a discharge electrode also located at the end of the wand. A key feature of the '507 design is that the wand is flexible to aid in reaching into difficult locations.

U.S. Pat. No. 4,253,820 is to an igniter shaped like a pistol having a trigger switch to release the gas into the wand, the gas being ignited by a match placed at the end of the wand.

U.S. Pat. No. 3,947,731 is to a trigger activated igniter which includes a normally closed, spring loaded valve. Depressing the trigger pulls back the valve, compressing the spring allowing gas to flow. At the same time the spark is activated, igniting the gas.

U.S. Pat. No. 3,576,471 is a pistol shaped igniter with a trigger switch. Depression of the trigger opens the gas valve and cocks a striker hammer which in turn strikes a piezoelectric crystal creating a spark to ignite the gas.

U.S. Pat. No. 5,154,601 is to a liquefied gas igniter having a top mounted trigger. Sliding the trigger longitudinally forward opens the fuel container and activates the piezoelectric chip which is located in the delivery tube forward of the trigger.

U.S. Pat. No. 4,538,983 to Zeller includes a top mounted trigger which, when pressed moves into the body at a 90° angle to the axis of the wand. Activation of the trigger causes a rotatable cam 27 to swing forward activating the piezoelectric mounted forward of the trigger and to rotate rocker lever 16,17, located rearward of the trigger to open the gas valve.

U.S. Pat. No. 4,516,933 is directed to an igniter with a top mounted switch where the improvement is a fuel reservoir which constitutes a major portion of the handle. There is no discussion of the functioning of the unit or the location or interaction of the various components.

The igniter of U.S. Pat. No. 4,292,021 has a top mounted, L-shaped trigger. When the exposed portion of the trigger is rotated rearwardly a lever, which constitutes the bottom half of the L-shaped trigger, rotates forward inside the body opening the gas valve and activating the piezoelectric chip causing a spark to be generated at the end of the wand where the gas outlet is located. A fuel control knob is exposed through the handle so that it can be operated by the same hand which also activates the trigger.

U.S. Pat. No. 4,273,528 is directed to a tubular igniter with a sliding trigger which can be operated either as a top mounted, thumb activated trigger or as a bottom mounted trigger operable by other fingers.

Surface mounted activation buttons, which could be depressed down into, or slid along, the surface of the handle are shown in U.S. Design Pat. Nos. D403,206, D382,444, D382,172, D380,936, D314,118, D295,598, D293,603, D277,307, D277,307, D267,820, D258,840, D254,872, D241,645 AND D231,119. Aside from showing a trigger mechanism which can be activated by movement of a users thumb, and various surface mounted switches of unknown utility theses design patents fail to show a mechanic structure that functions in the same way as applicant's invention.

Upon review of the products on the market it has become apparent that there is a need for an easily operated device which includes the ability to reach into enclosed spaces while at the same time having the flexibility of providing a variable sized flame, an ability to refill the fuel container in an easy manner and an easy controlled, but not easily avoided, mechanism to prevent the device from being inadvertently ignited, particularly by children who may unintentionally obtain access to the device.

SUMMARY OF THE INVENTION

An igniter embodying features of the invention generates a flame for used in igniting logs or charcoal. The externally visible components of the igniter consist of a handle which can be readily grasped within the hand of a user and a flame tube (wand) extending from the handle. A thumb activated trigger (thumb button) extends out of and above the handle. The trigger is mounted to move forward and into the housing at an angle to an axial line through the center of the wand. The igniter also includes a child proof, spring loaded lock, extending through the bottom front edge of the handle. The lock prevents the trigger from being depressed if the lock button is not simultaneously depressed. Projecting through the side of the handle is a valve control. Adjusting the valve handle varies the size (length) of the flame.

Enclosed within the handle is a small refillable cylinder which holds liquefied or compressed propane or butane gas or another suitable, flammable, readily vaporizable gas. As the trigger is advanced a rocker is caused to pivot forward, the movement of the rocker activating the valve on the gas cylinder to cause gas to be released. The lock mechanism interferes with and prevents forward movement of the trigger, thus preventing rotation of the rocker. With the lock released, depressing the trigger releases gas from the cylinder and simultaneously activates a piezoelectric crystal. The gas flowing down the flame tube is ignited within the handle at a point forward of the trigger by a spark generated by the piezoelectric crystal. The flame from the ignited gas exits the forward end of the wand.

These features make the igniter embodying features of the invention easier and safer to use than previously offered gas igniter devices.

DESCRIPTION OF THE FIGURES

These and other features, aspects and advantages of the present invention will become better understood with reference to the following description, appended claims and accompanying drawings, where:

FIG. 10 is a perspective view of the rocker including a portion of the gas tube;

FIG. 11 is a perspective view of the thumb trigger; and

DETAILED DESCRIPTION OF THE INVENTION

Figure 1:
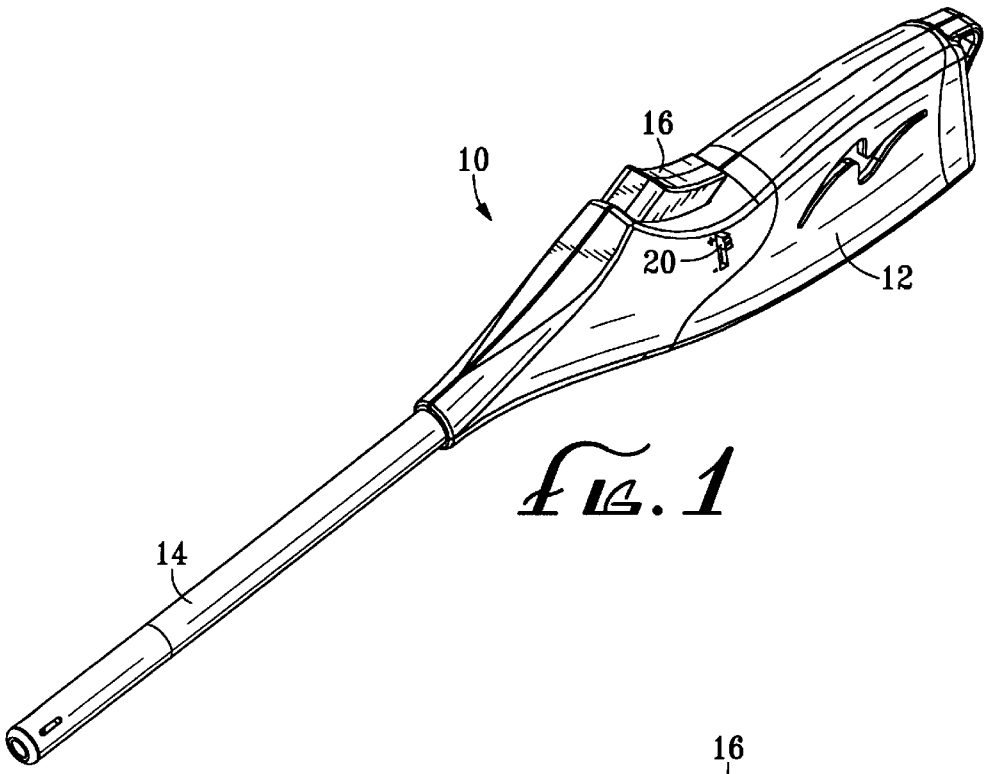
FIG. 1 is a perspective view of a the igniter embodying features of the invention.
Figure 2:
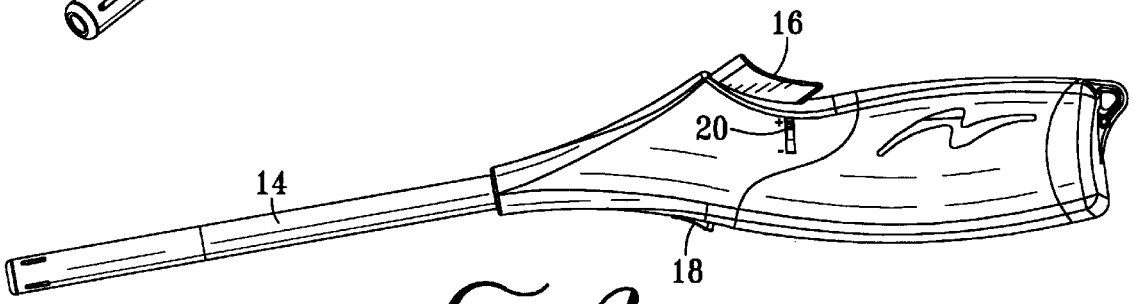
FIG. 2 is a front elevational view thereof.
Figure 3:
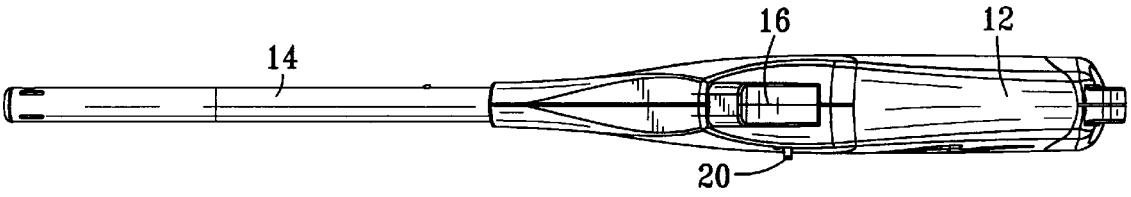
FIG. 3 is a top elevational view thereof.
Figure 4:
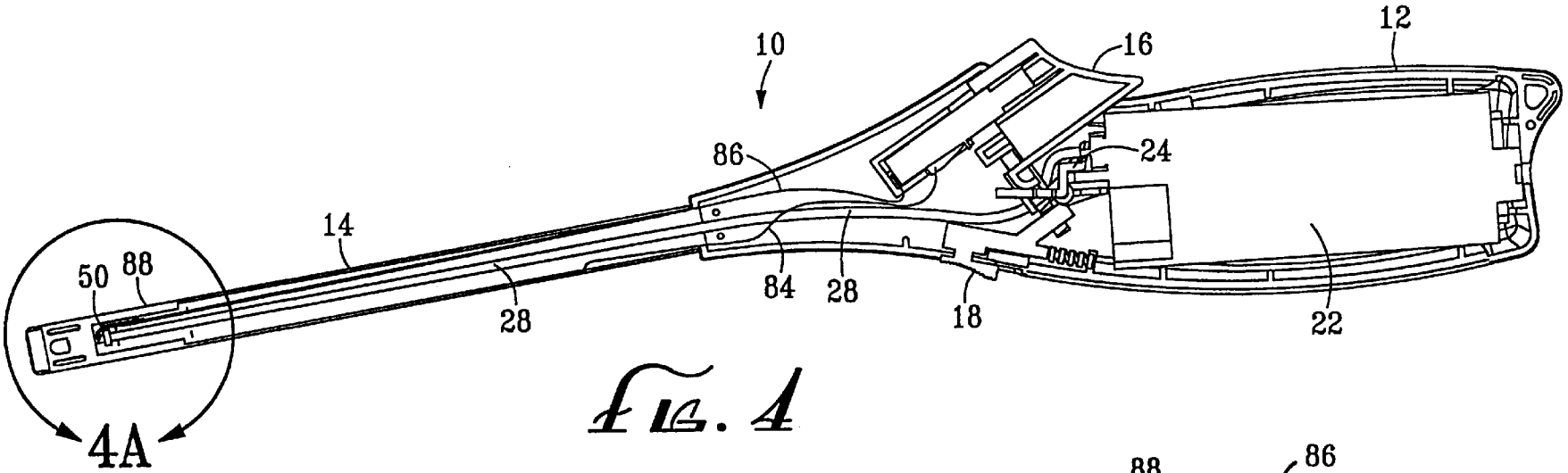
FIG. 4 is cut away front elevational view of the device shown in FIG. 2.
Figure 4A:
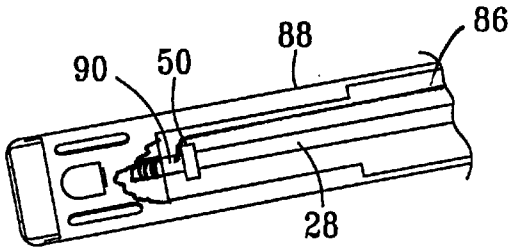
FIG. 4*a* is an enlarged cutaway view of the end of the flame tube.

FIGS. 1–12 show a preferred version of the igniter embodying features of the invention. The igniter 10 comprises a hollow handle 12 with a hollow flame tube or wand 14 extending forward from the handle 12. Extending through the top of the handle 12, and spaced back from the point where the wand 14 exits from the front end of the handle 12, on the front edge of the central portion of the handle 12, is a thumb activated trigger 16 Extending through the bottom of the handle, at approximately the same lateral location as the trigger 16, is a spring loaded lock 18. The handle is sized, shaped and contoured so that when the handle is grasped in the palm of an adult user's hand in a hand shake like grip, the user's thumb rests on the trigger 16 and the index finger is positioned against the lock so that the lock can be slid to the rear of the handle releasing the trigger which is depressed substantially simultaneously.

Figure 5:
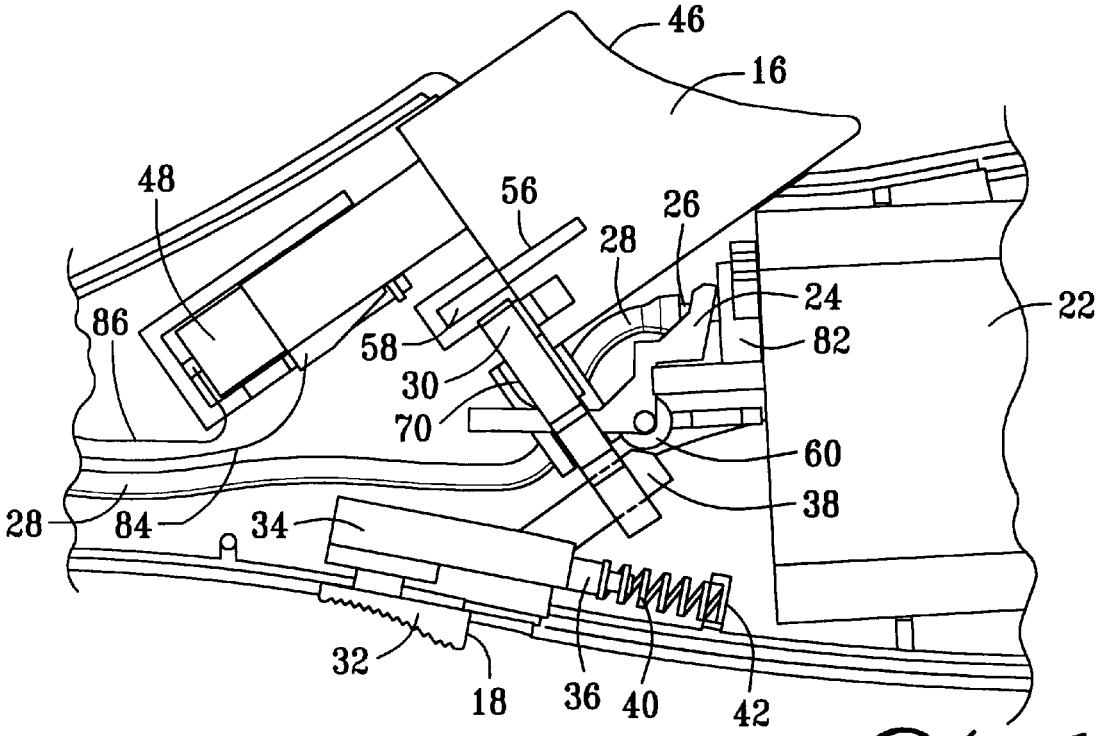
FIG. 5 is an enlarged cutaway view of the central portion of the device shown in FIG. 4 with the lock in its closed position.
Figure 6:
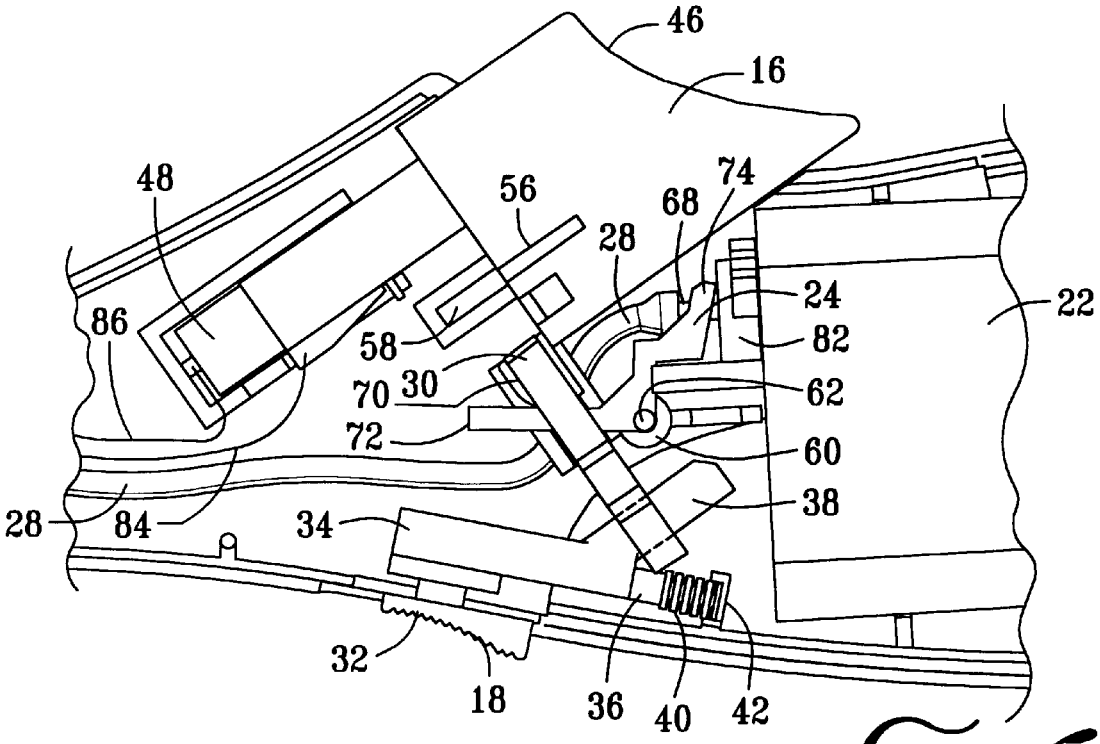
FIG. 6 is an enlarged cutaway view of the central portion of the device shown in FIG. 4 with the lock in its open position.
Figure 7:
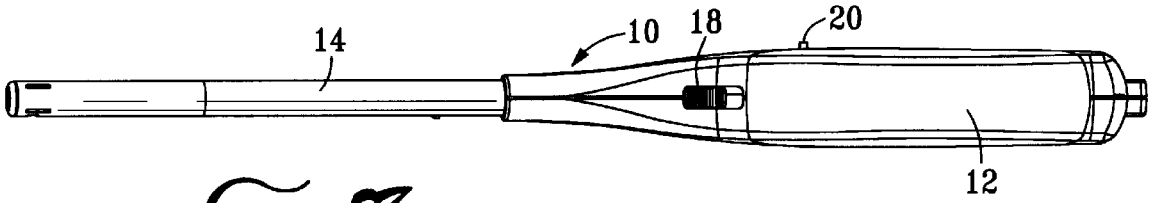
FIG. 7 is a bottom elevational view thereof.

FIGS. 5 and 6 are cutaway views showing the several internal components enclosed within the handle. The trigger 16 is mounted to move forward and into the handle 12 at an angle to an axial line (not shown) through the center of the wand 14. If the lock 18 is not retracted when the trigger 16 is depressed, the trigger 16 is prevented from moving. Restriction of the movement of the trigger 16 also prevents the gas from being released and the piezoelectric crystal from being activated to create a spark. Projecting through the side of the handle 12, also substantially in line linearly with the trigger 16 and lock 18 is a valve control 20. Adjusting the valve control 20 varies the size (length) of the flame which exits the end of the wand 14.

Enclosed within the handle 12 is a small, refillable pressure tank 22 which holds liquefied or compressed propane or butane gas, or another suitable, flammable, readily vaporizable gas. As the trigger 16 is advanced a rocker 24 is caused to pivot forward, The movement of the rocker 24 pulls on a barb on the external end of the exhaust port 26 which opens a valve 82 which is on the forward end of the gas tank 22, causing the gas to be released from the tank 22 through exhaust port 26 and the tube 28 attached thereto. If the lock is not retracted, the lock mechanism 18, in cooperation with yoke 30, interferes with and prevents forward movement of the trigger 16, thus preventing rotation of the rocker 24.

FIGS. 5 and 6 are enlarged cutaway views showing the trigger 16, lock 18, valve control 20, tank 22, rocker 24, exhaust port 26, tube 28, piezoelectric spark generator 48 and wires 84, 86 with the device in its locked and unlocked position, respectively. FIGS. 8–11 show each of the yoke 30, lock 18, rocker 24 and trigger 16 respectively.

Figure 9:
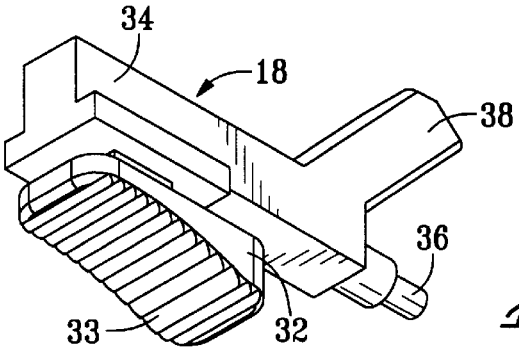
FIG. 9 is a perspective view of the lock actuator.

FIG. 9 shows a locking structure. This lock is intended to provide protection from operation of the igniter by a child who is not dexterous enough to depress the trigger and withdraw the lock in a substantially simultaneous movement which is necessary for the igniter to produce a flame. The trigger 16 has an upper surface 46 which is exposed through the top of the handle 12. Abutting the inside surface of the trigger 16 is a piezoelectric spark generator 48. The trigger 16 is supported inside the handle 12 by guiding grooves on the inner surfaces of the handle 12. When the trigger 16 is depressed by the thumb of a user, as long as the lock 18 is in its actuated position, where the movement of trigger 16 is not retarded, the spark generator 48 is activated. An electric current flows from the spark generator 48 and metal nozzle 90 causing a spark to jump across the gap between the tip and nozzle igniting the flowing gas stream at or past the metal nozzle 90 on the exit end 50 of the tube 28. On the surface of the trigger 16, near its lower end, are two blocks 52 which, as discussed below, interfere with the legs 54 of the yoke 30 to prevent inadvertent activation of the device. While the yoke 30 is shown with two legs 54 which rest in front of the blocks 52, it is contemplated that the yoke may also include other structure which resides in front of the trigger until released to give an even more solid blocking action. On the other hand, a single leg on one side or an extension in front of the trigger may be used in place of both legs. The main criteria is a removable component which stops movement of the trigger unless unlocked.

Next to, but spaced above the blocks 52 are raised ridges 56 which ride in slots 58 on the internal surfaces of the handle 12. This combination helps to keep the trigger properly positioned. A spring (not shown) within the piezoelectric spark generator 48 returns the trigger 16 to its rest position when the trigger is released. Also on a lower internal end of the trigger is a camming surface 70 which rides on the forward actuation surface 71 on the forward end 72 of the rocker 24, causing the rocker 24 to pivot forward upon depressing the trigger 16.

Referring to FIG. 9, the lock 18 includes a button 32 which has a knurled or roughened contact surface 33 to increase friction between the button surface and the user's index finger. This button 32 is exposed through the bottom surface of the handle 12. Integral with the button 32, and internal to the handle 12, is a lock body 34 with a rearward extending spring receiver 36 and, extending upwardly at an angle to the lock body 34, an extension 38. The extension 38 sets within an opening in the base of the yoke. However, other structure can be provided in place of the extension to cause the yoke to move out of interference with the trigger on activation of the lock button. Mounted on the spring receiver 36 is the forward portion of a compressible spring 40, the rear end of the spring 40 resting against a stop 42 integral with the internal surface of the handle 12. Alternatively, the spring can be mounted under and against the bottom of the yoke so that when the trigger is released the yoke is forced upward driving the lock forward and the yoke upward.

Figure 8:
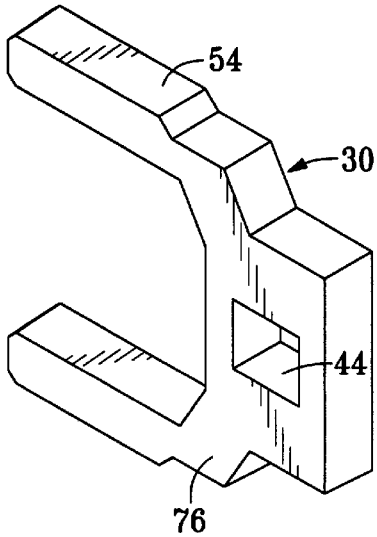
FIG. 8 is a perspective view of the yoke.

Referring to FIGS. 5, 6 and 10, collars 60 on the inside surface of the handle receive pins 62 which extend out of both sides of the rocker 24. When the pins 62 are seated in the collar 60 the exhaust port 26 resides within a unshaped opening 64 in rear portion 74 of the rocker 24. The unshaped opening 64 has a raised internal edge 66 which is used to grasp the barbed tip 68 on the exhaust port 26 exiting the forward end of the gas reservoir 22. Forward rocking motion of the rear portion on 74 of the rocker 24 causes the raised edge 66 to press forward against the barbed tip 68, which, in turn, opens the valve 82 allowing the gas to flow. Referring to FIGS. 5, 6 and 8, the yoke 30 is wishbone shaped with two legs 54 extending from a base 76. The base 76 has an opening 44 sized to receive the extension 38 on the lock 18.

Figure 12:
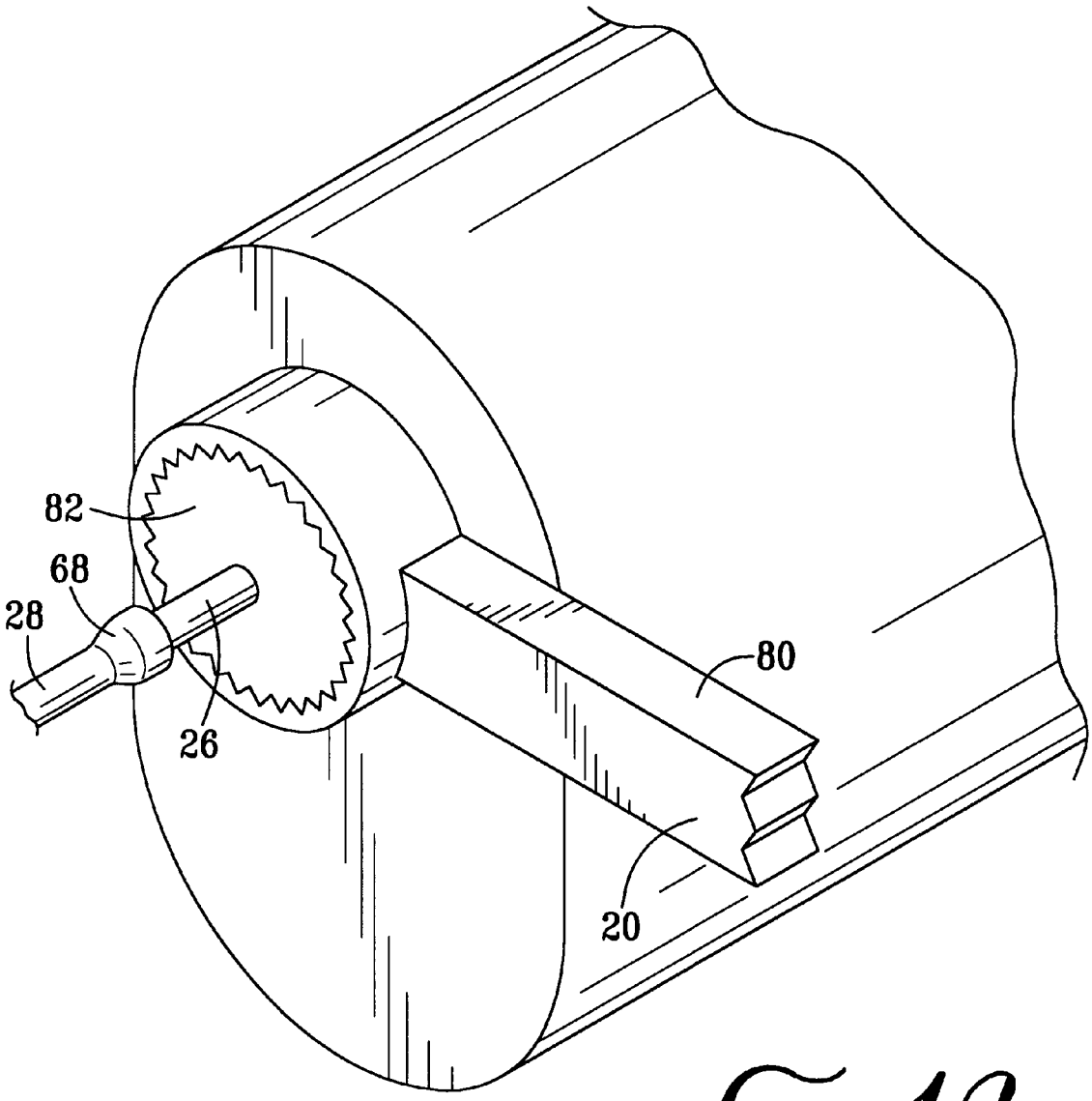
FIG. 12 is a perspective view of the gas flow control handle mounted on the gas valve on the end of the gas filled cylinder.

Another feature of the igniter 10 is the ability to adjust the size of the flame. The gas flow valve 82, located at the juncture of the exhaust port 26 with the forward end of the tank 22, can be rotated in relationship with the tank 22. This rotation adjusts the gas flow rate through the valve 82. FIG. 12 shows an adjustment tool 80 which is placed over the outer surface of the valve so that the valve control handle 20 extends through the wall of the handle 12. Moving the portion of the handle 20 which extends through the wall of the handle 20 changes the gas flow rate and, as a result, the flame size.

When the lock 18 is actuated, depressing the trigger 16 releases gas from the cylinder 22 and simultaneously activates a piezoelectric device 48 to create a spark. The gas flowing down and exiting out of the metal nozzle 90 on the end 50 of the tube 28 in the wand 14 is ignited by the spark generated by the piezoelectric device. The flame from the ignited gas then exits the forward end of the wand. The substantially simultaneous events which occur during the activation of the igniter are as follows:

1) The lock is moved rearward by a sliding pressure applied to the knurled contact surface 33 of the button 32.
2) The rearward movement causes the extension 38 located in opening 44 in the yoke 30 to pull the yoke 30 downward so that the legs 54 are removed from the path of the two blocks 52 on the sides of the trigger 16.
3) The trigger 16 is depressed, causing the cam surface 70 on the trigger to impose a downward and forward pivoting action on the forward activation surface 71 on the forward end 72 of the rocker 24. This downward and forward pivoting action of the forward end also causes a forward pivoting action of the rear portion 74 of the rocker 24. This forward pivoting action of the rear portion 74 of the rocker 24 causes the barbed end 68 of the exhaust port 26 to be pulled forward, opening the gas flow valve 82 on the end of the gas cylinder 22 and allowing the flammable gas to flow down the tube 28 to the tip of the wand 14.
4) Depressing the trigger also activates the piezoelectric spark generator 48, causing an electric charge to flow through wires 84, 86 and create a spark at or near the end of the metal nozzle 90, between the nozzle 90 and the metal tip 88, igniting the gas.
5) When the thumb trigger 16 is released, the spring in the piezoelectric spark generator causes the trigger to return to its rest position, the gas flow ceases, the spark is terminated and the flame is extinguished due to a lack of flammable gas.
6) When the lock is released, the spring 40 drives the lock body 34 forward, moving the yoke 30 upward. The legs 54 of the yoke 30 are returned to their blocking position in front of the trigger 16.

If the lock button is not moved to the rear, the legs 54 of the yoke 30 are not removed from the path of the blocks 52 on the sides of the trigger 16 and the trigger 16 can not be depressed. As a result the gas is not released and the spark is not activated.

Although the present invention has been described in considerable detail with reference to certain preferred versions and uses thereof, other versions and uses are contemplated by the invention. For example, a spark generator or gas ignition device other than a piezoelectric spark generator can be activated by movement of the trigger. As an example, a hot surface may be generated in the path of the gas to ignite the gas. Further, the flame itself, once ignited could generate a hot surface, which would re-ignite the gas in the event of windy conditions which extinguish the flame. Additionally, movement of the rocker can open or activate a broad range of valve mechanisms, known to those skilled in the art, which can control the flow of the gas. Likewise, the means for varying the gas volume delivered can also be replaced by other devices with the same function. Other variations contemplated within the general scope of the device described above include replacing the wish bone shaped child lock yoke with a simpler lock which blocks the trigger motion at one side, more complex shapes blocking the trigger motion at three or more sides, elimination of the child lock return spring requiring manual reset. Molding the child lock return spring as an integral plastic molded spring or moving the location of the child lock button to the sides or top of the handle.

I claim:

1. An igniting device comprising a body portion with a hollow flame delivery tube attached thereto, said body portion enclosing a flammable fluid reservoir, a valve mechanism operating to control release of a flammable gas from the reservoir, a piezoelectric unit for generating a spark to ignite the flammable gas within the hollow flame delivery tube and a trigger mechanism to open the valve mechanism and activate the piezoelectric unit to provide a spark to ignite the flammable gas released by opening the valve mechanism to create a flame extending from the hollow flame delivery tube, wherein:

said trigger mechanism comprises a button mounted in an opening in an upper surface of the body portion and an L-shaped rocker arm enclosed within the body portion and operatively connected to the button, said button being movable, by applying finger pressure to the button in a direction at least partially into said body portion and in a direction toward the hollow tube, said movement causing a) a first end of said L-shaped rocker arm in contact with an internal portion of the button to move downward and a second end of said L-shaped rocker arm to rotate upward, said upward rotation causing the valve mechanism to open, releasing flammable gas into the hollow tube, and b) pressure to be applied to the piezoelectric unit generating a spark within the flammable gas in the hollow tube, igniting the gas, said body portion having mounted in a sliding fashion therein a spring loaded locking structure, said locking structure in its resting position interacting with an interfering yoke enclosed with the body portion to prevent the trigger from being depressed and said locking structure in an activated position moving the locking yoke from its interfering position with the trigger, allowing free movement of the trigger and opening of the gas valve.

2. The igniting device of claim 1 wherein the trigger button moves downward and forward into the handle at an angle to an axis passing through the center of the flame delivery tube.

3. The igniting device of claim 1 wherein the locking structure, once activated, causes a trigger movement blocking structure to be withdrawn from its blocking position, allowing forward movement of the trigger.

4. The igniting device of claim 1 wherein the flammable gas flows from the gas reservoir to the end of the hollow flame delivery tube through a tubular conduit attached to the valve on the gas reservoir and routed through an opening within structure operatively connecting the lock with the trigger.

5. The igniting device of claim 1 further including gas flow adjustment means extending through the handle and connected to the valve for varying the size of the flame extending from the hollow flame delivery tube.

6. A portable device for delivering a burning gas to a flammable target, said device operable by a single hand of an operator, comprising:

a valved reservoir containing the gas, said reservoir enclosed within a handle of the device, a conduit for transmitting the gas from the reservoir to a flame delivery end of a hollow tube extending from said handle, said flame delivery end being remote from the point of connection of the tube to the handle a thumb activated trigger operatively connected to the valved gas reservoir so that forward movement of the trigger a) causes the gas to be transmitted through the conduit to the flame delivery end of the hollow tube and b) activates a gas ignition means, said gas ignition means causing the gas to ignite at the flame delivery end of the hollow tube a child safety lock extending through a lower surface of the handle and operatively mounted within the handle, said child safety lock preventing forward movement of the trigger unless activated, the child safety lock activated by rearward movement thereof along said lower surface by the index finger on said hand of the operator.

7. The portable device of claim 6 wherein activation of the child safety lock temporarily repositions a blocking structure from its position preventing the forward movement of the trigger and release of the child safety lock and trigger restores the blocking structure to its position preventing the forward movement of the trigger.

* * * * *